US009327389B2

(12) United States Patent
Chen

(10) Patent No.: US 9,327,389 B2
(45) Date of Patent: May 3, 2016

(54) RATCHET WRENCH

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 249 days.

(21) Appl. No.: 14/188,695

(22) Filed: Feb. 25, 2014

(65) Prior Publication Data

US 2015/0239104 A1 Aug. 27, 2015

(51) Int. Cl.
*B25B 13/46* (2006.01)
*B25B 23/00* (2006.01)

(52) U.S. Cl.
CPC ..... *B25B 13/463* (2013.01)

(58) Field of Classification Search
CPC .... B25B 13/463; B25B 13/461; B25B 23/00; B25B 23/0007
See application file for complete search history.

(56) References Cited

U.S. PATENT DOCUMENTS 6,655,237 B2 * 12/2003 Chen ..... B25B 13/463 81/60
6,691,594 B2 * 2/2004 Chen ..... B25B 13/463 81/61
6,904,832 B1 * 6/2005 Chen ..... B25B 23/0035 81/63
6,945,141 B2 * 9/2005 Hu ..... B25B 13/463 81/63
6,964,216 B2 * 11/2005 Chen ..... B25B 13/463 81/63.1
6,971,285 B2 * 12/2005 Chen ..... B25B 13/463 81/177.85
6,971,287 B2 * 12/2005 Lee ..... B25B 13/463 81/60
6,981,433 B2 * 1/2006 Hsien ..... B25B 13/463 81/60
6,981,434 B2 * 1/2006 Chen ..... B25B 13/463 192/43.1
6,988,429 B2 * 1/2006 Lee ..... B25B 13/463 81/60
7,017,453 B2 * 3/2006 Hu ..... B25B 13/463 81/63
7,059,219 B2 * 6/2006 Arnold ..... B25B 13/463 81/63
7,062,994 B2 * 6/2006 Chen ..... B25B 13/463 81/62
7,080,579 B2 * 7/2006 Chen ..... B25B 13/463 192/43.2
7,082,859 B2 * 8/2006 Huang ..... B25B 13/463 81/62
7,082,861 B1 * 8/2006 Chen ..... B25B 13/463 81/63
7,152,508 B2 * 12/2006 McCalley, Jr. ..... B25B 13/08 81/53.2
7,178,429 B2 * 2/2007 Lin ..... B25B 13/463 81/58
7,353,735 B2 * 4/2008 Patel ..... B25B 13/463 81/60
7,441,482 B2 * 10/2008 Lin ..... B25B 13/463 81/177.85
7,444,903 B1 * 11/2008 Li ..... B25B 13/463 81/60
7,444,904 B2 * 11/2008 Huang ..... B25B 13/463 192/43.2
7,661,337 B2 * 2/2010 Chen ..... B25B 13/463 81/62
7,827,886 B2 * 11/2010 Hu ..... B25B 13/463 192/43.2
7,921,751 B2 * 4/2011 Hu ..... B25B 13/463 81/63.1

(Continued)

*Primary Examiner* — David B Thomas

(57) ABSTRACT

A ratchet wrench includes a wrench body, a ratchet assembly and a C-ring. The wrench body has a driving head at one end. The driving head has a cavity therein and a retaining groove defined in an inner periphery of the cavity. The ratchet assembly is mounted in the cavity of the driving head. The C-ring is configured to retain the ratchet assembly in place and defines an outer portion and an inner portion. The C-ring has two free ends, and at least one of the two free ends has an oblique face with a pointed edge towards an inside of the C-ring, which is allowed to pry the C-ring moving inward to be detached.

5 Claims, 7 Drawing Sheets

(56) References Cited

U.S. PATENT DOCUMENTS

RE42,768 E * 10/2011 Huang ..... B25B 13/463 81/62
8,186,247 B1 * 5/2012 Chen ..... B25B 13/463 81/29
8,215,207 B2 * 7/2012 Huang ..... B25B 13/463 81/63.1
8,291,792 B2 * 10/2012 Yang ..... B25B 13/463 81/60
8,342,059 B2 * 1/2013 Hu ..... B25B 13/463 81/60
8,387,489 B2 * 3/2013 Hsu ..... B25B 13/06 81/124.5
8,397,605 B1 * 3/2013 Kao ..... B25B 13/463 81/58.1
8,413,550 B2 * 4/2013 Hu ..... B25B 13/463 81/60
8,485,069 B1 * 7/2013 Chen ..... B25B 13/463 81/60
8,516,926 B1 * 8/2013 Hsieh ..... B25B 13/463 81/60
8,596,170 B2 * 12/2013 Yang ..... B25B 13/463 81/60
8,616,095 B2 * 12/2013 Chi ..... B25B 13/463 81/58.5
8,683,894 B1 * 4/2014 Chen ..... B25B 13/463 81/443
9,016,174 B2 * 4/2015 Lee ..... B25B 13/463 81/60
2004/0025643 A1 * 2/2004 Hsien ..... B25B 13/463 81/60
2004/0025645 A1 * 2/2004 Shu-Ying ..... B25B 13/463 81/63
2010/0275737 A1 * 11/2010 Lin ..... B25B 13/463 81/63
2013/0139656 A1 * 6/2013 Chang ..... B25B 13/463 81/63.2
2014/0000415 A1 * 1/2014 Lee ..... B25B 13/463 81/60
2014/0026720 A1 * 1/2014 Chang ..... B25B 23/12 81/60
2014/0366690 A1 * 12/2014 Lee ..... B25B 13/463 81/63.2
2015/0135909 A1 * 5/2015 Chen ..... B25B 13/463 81/63.2

* cited by examiner

RATCHET WRENCH

BACKGROUND OF THE INVENTION

1. Field of the Invention

The present invention relates to a ratchet wrench, and more particularly to a ratchet wrench with an improved retaining ring to simplify a removal process.

2. Description of Related Art

A conventional ratchet wrench includes a wrench body 5, a C-shaped retaining ring 6 and a socket 7, as shown in FIG. 6. The wrench body 5 has a driving head 51 at one end. The driving head 51 has a cavity therein and an annular groove 511 defined in an inner periphery of the cavity. The C-shaped retaining ring 6 is mounted on the annular groove 511 to retain the socket 7 in place. However, two free ends of the C-shaped retaining ring 6 each is vertical plane that is hard to operate.

In order to improve above disadvantage, another conventional ratchet wrench has an improved C-shaped retaining ring 8, as shown in FIG. 7. The C-shaped retaining ring 8 has two snap portions 81 at two free ends thereof. Each of the two snap portions 81 has a bore 811 defined in a center thereof. Therefore, a small screwdriver could be inserted into two bore 811 of the two snap portions 811 to snap out the C-shaped retaining ring 8. However, the C-shaped retaining ring 8 with two snap portions 81 is relative high manufacturing cost.

The present invention has arisen to mitigate and/or obviate the disadvantages of the conventional ratchet wrench.

SUMMARY OF THE INVENTION

The main objective of the present invention is to provide an improved ratchet wrench.

To achieve the objective, a ratchet wrench comprises a wrench body, a ratchet assembly and a C-ring. The wrench body has a driving head at one end. The driving head has a cavity therein and a retaining groove defined in an inner periphery of the cavity. The ratchet assembly is mounted in the cavity of the driving head. The C-ring defines an outer portion and an inner portion. Wherein, the outer portion is inserted in the retaining groove of the driving head, and the inner portion is exposed to retain the ratchet assembly in place. The C-ring has two free ends. At least one of the two free ends has an oblique face with a pointed edge towards an inside of the C-ring.

The C-ring has a gap defined between the two free ends thereof. The oblique face of the C-ring is inclined from the outer portion to the inner portion. Additionally, the oblique face of the C-ring could be slightly concaved. Moreover, the ratchet assembly has a socket mounted in the cavity of the driving head. The socket has a driving hole defined therethrough. The socket has a shoulder at a top side, and the inner portion of the C-ring abuts against the shoulder of the socket.

Further benefits and advantages of the present invention will become apparent after a careful reading of the detailed description with appropriate reference to the accompanying drawings.

DETAILED DESCRIPTION OF THE INVENTION

Figure 1:
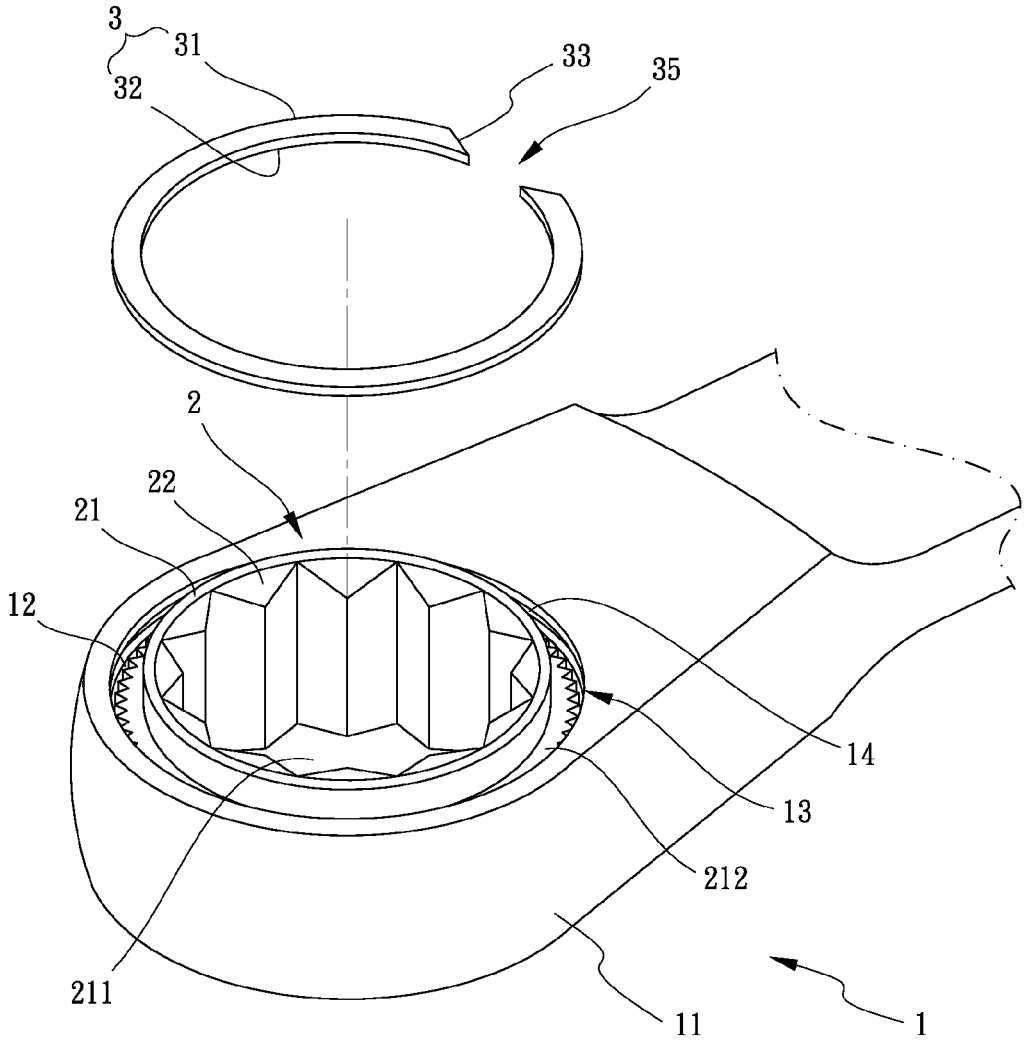
FIG. 1 is a partial exploded perspective view of a ratchet wrench in accordance with a first embodiment of the present invention.
Figure 2:
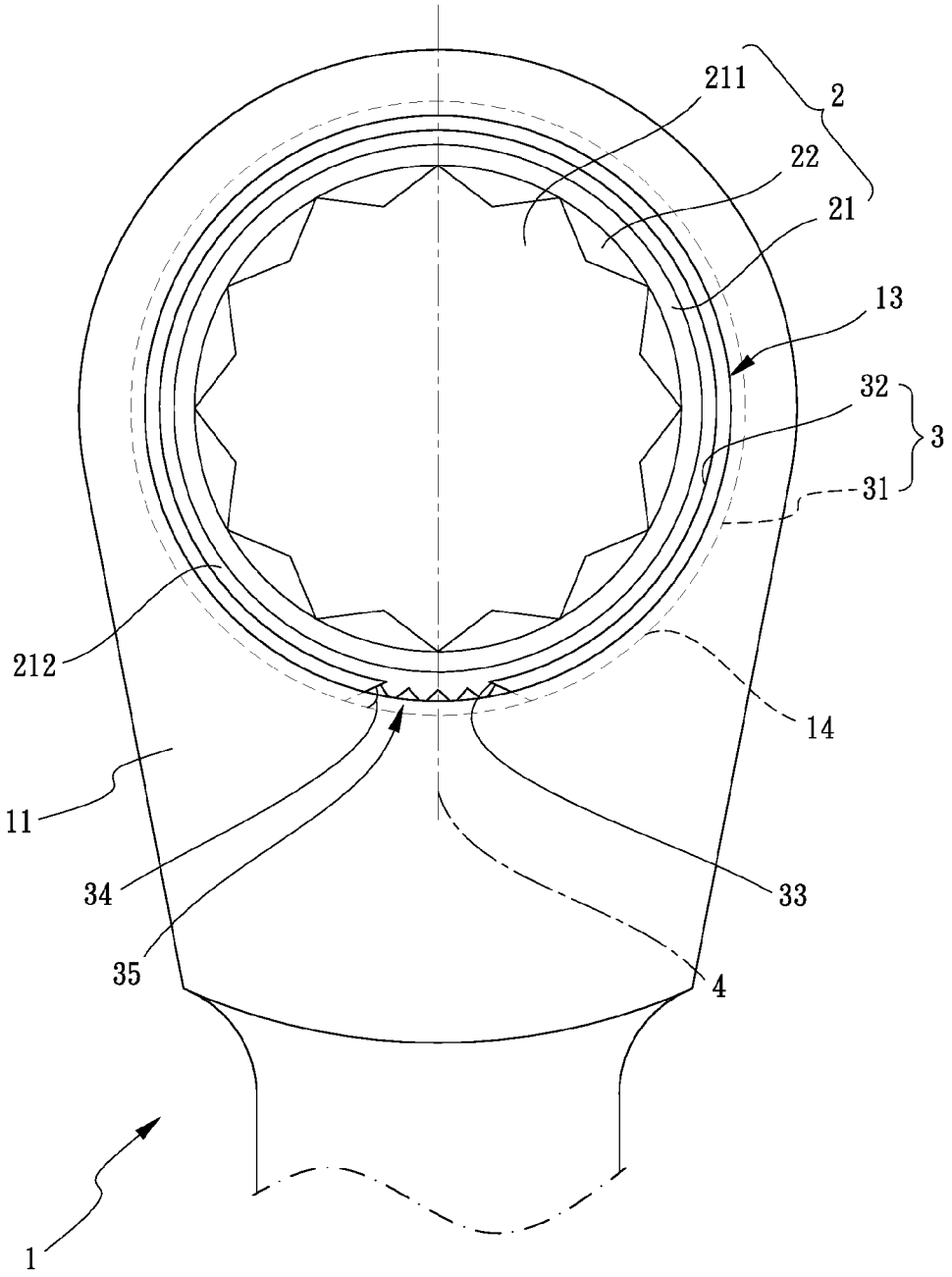
FIG. 2 is a top view of the ratchet wrench in FIG. 1, wherein a C-ring is mounted in a wrench body.

Referring to FIGS. 1-5, a ratchet wrench in accordance with the present invention comprises a wrench body 1, a ratchet assembly 2 and a C-ring 3. The wrench body 1 has a driving head 11 at one end thereof. The driving head 11 has a cavity 12 therein. The cavity 12 has an opening 13 at top of the driving head 11. The ratchet assembly 2 is mounted in the cavity 12 of the driving head 11. A retaining groove 14 is defined in an inner periphery of the cavity 12 near the opening 13 of the driving head 11. The C-ring 3 has an outer portion 31 and an inner portion 32. The outer portion 31 is inserted in the retaining groove 14 of the driving head 11, and the inner portion 32 is exposed to retain the ratchet assembly 2 in place.

Figure 3:
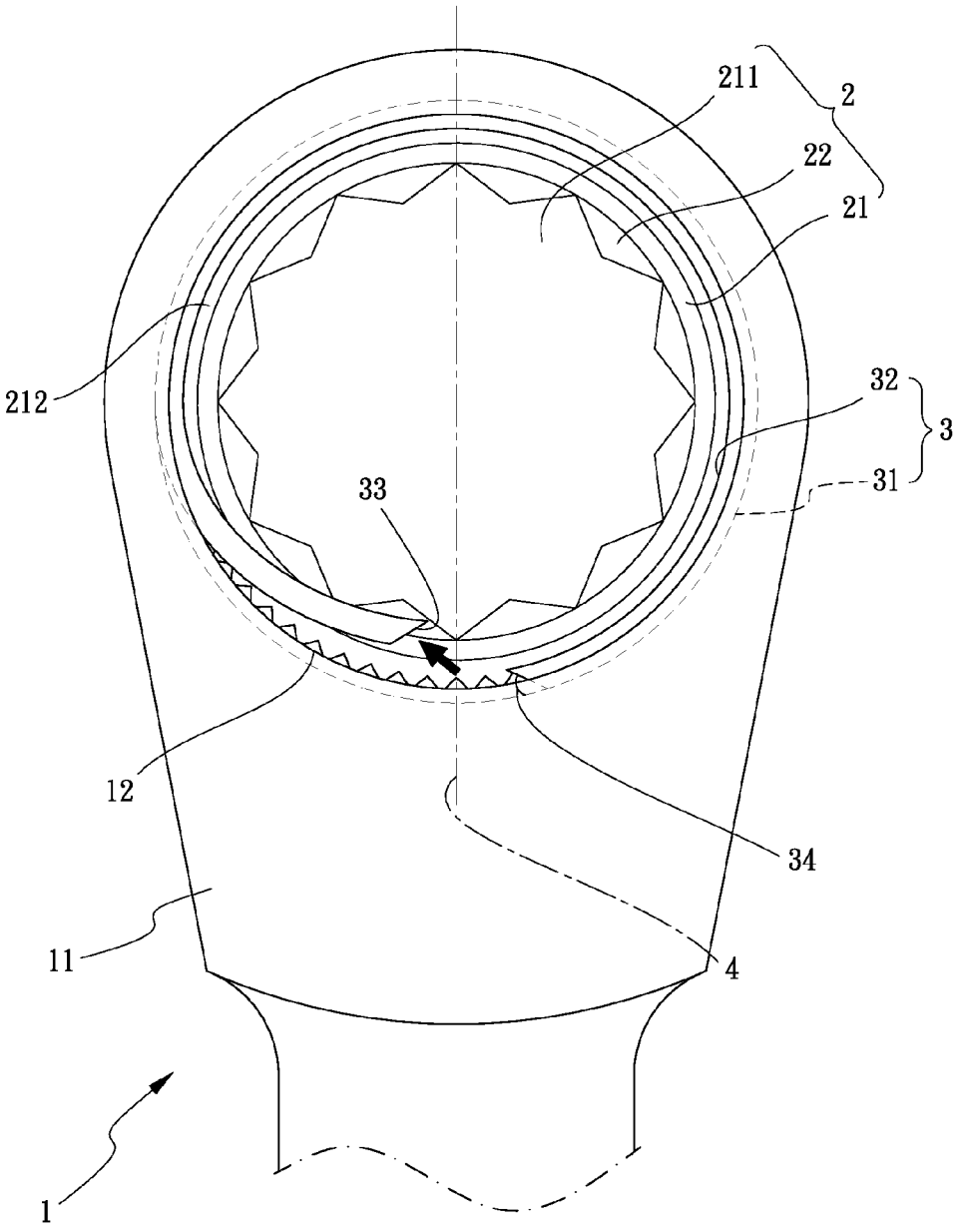
FIG. 3 illustrates the C-ring detaching from a cavity of the wrench body in FIG. 2.
Figure 4:
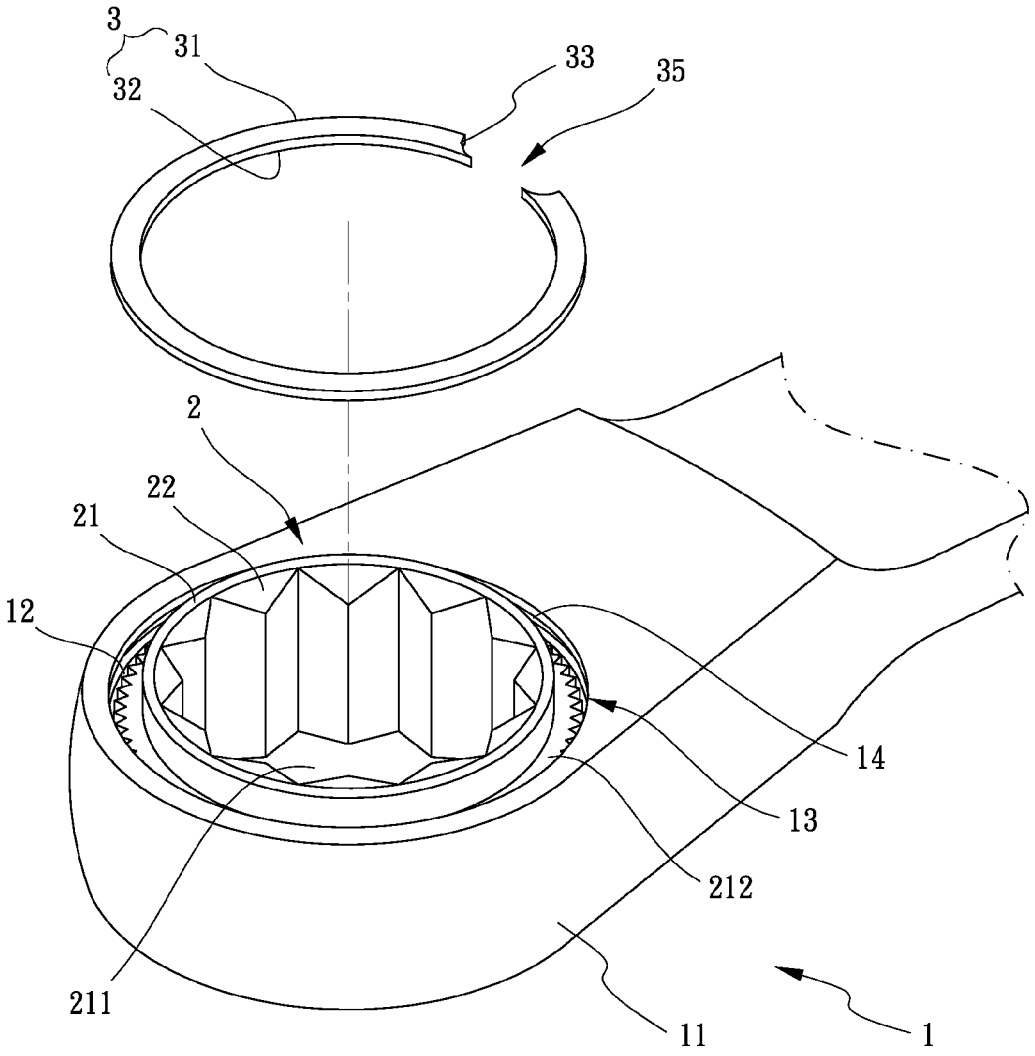
FIG. 4 is a partial exploded perspective view of a ratchet wrench in accordance with a second embodiment of the present invention.

Specifically, the C-ring 3 has two free ends. At least one of the two free ends has an oblique face 33 with a pointed edge towards an inside of the C-ring 3. As shown in FIG. 4, an angle 34 is defined between the oblique face 33 and an inner wall of the retaining groove 14, which allows a user to pry the C-ring 3 out via the oblique face 33. In this manner, the user could use a hand tool such as a small screwdriver to pry one end of the C-ring with the oblique face 33 moving inward so as to detach the C-ring 3, as shown in FIG. 3.

Figure 5:
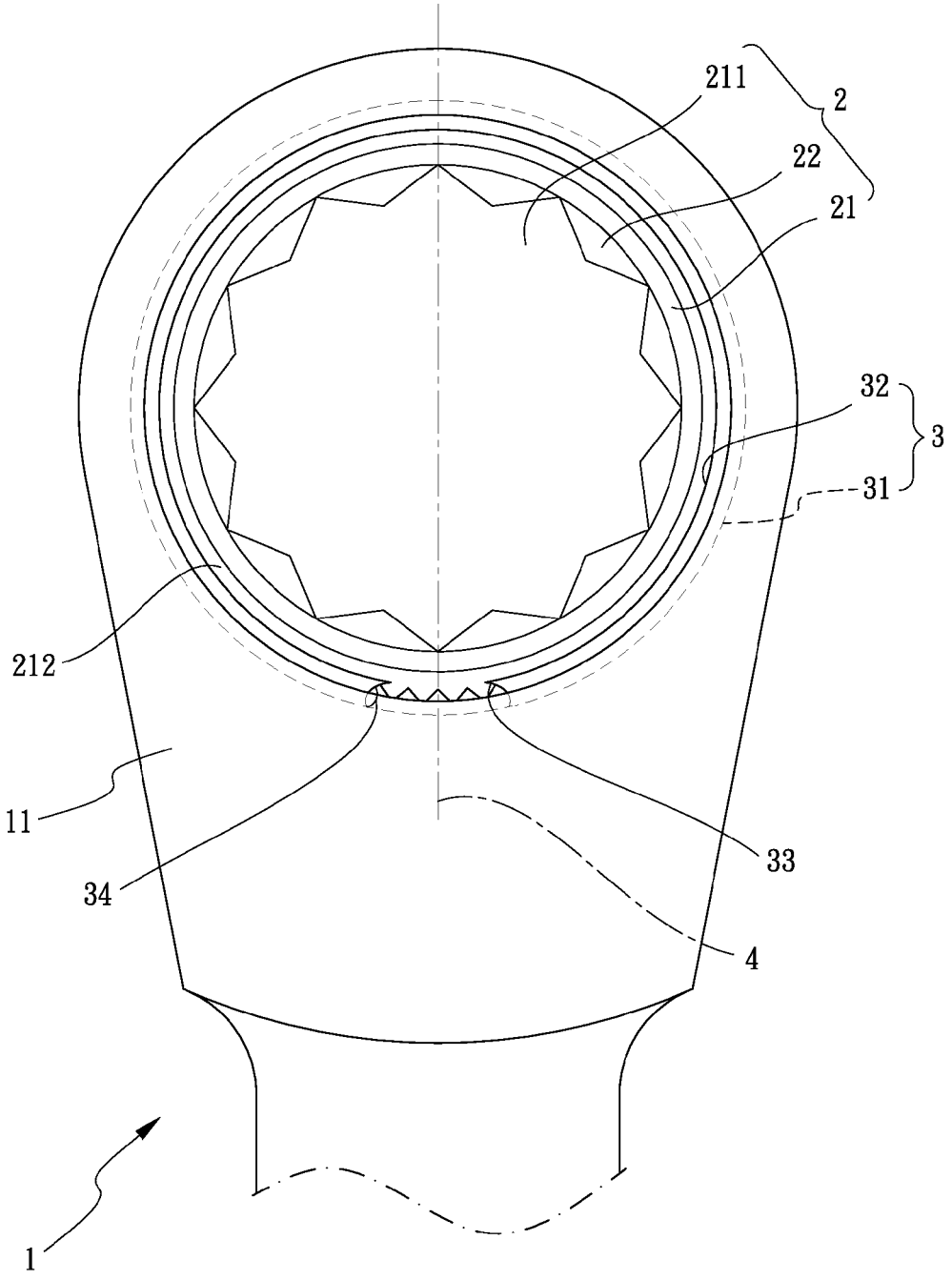
FIG. 5 is a top view of the ratchet wrench in FIG. 4, wherein the C-ring is mounted in the wrench body.
Figure 6:
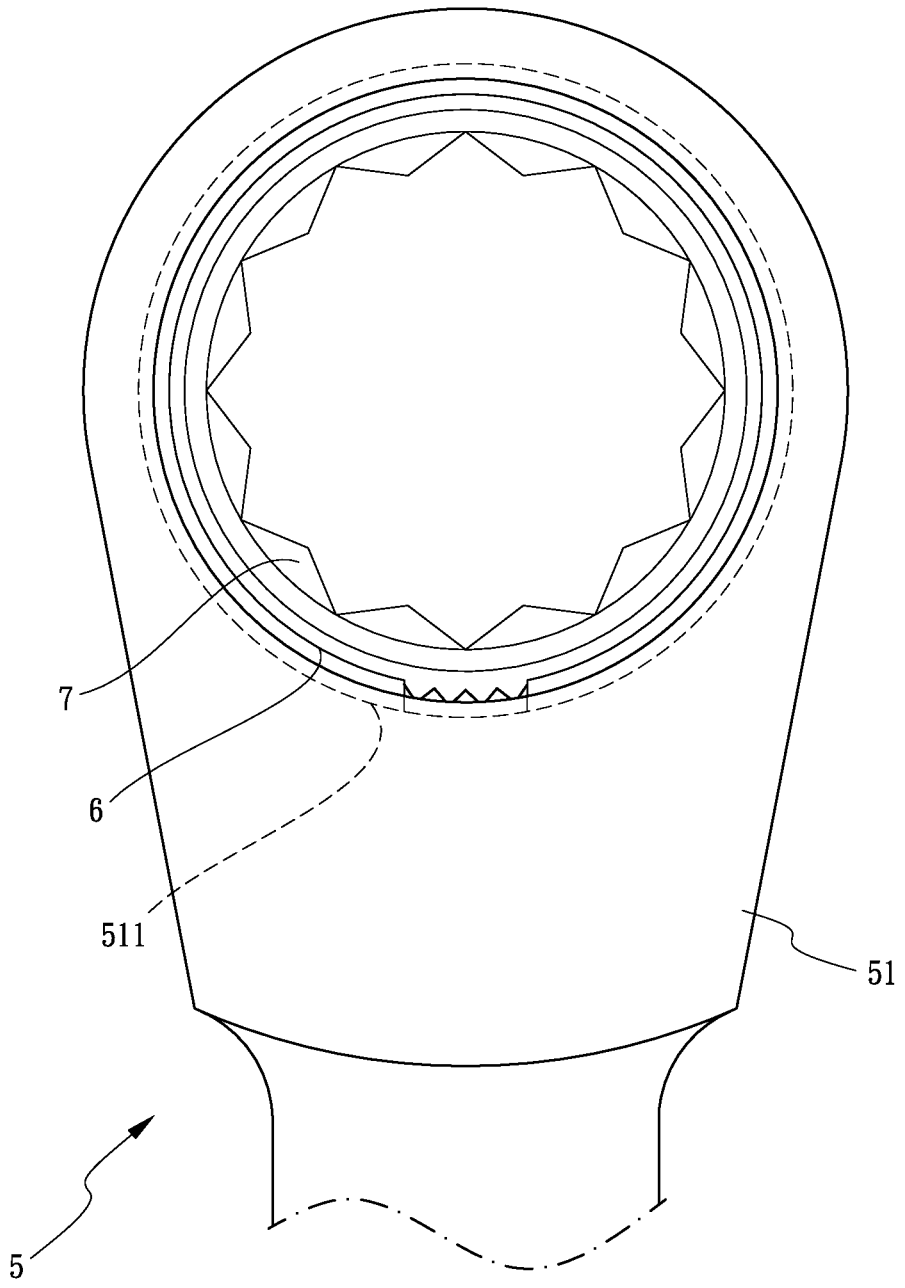
FIG.6 (Prior art)
FIG. 6 is a prior art.
Figure 7:
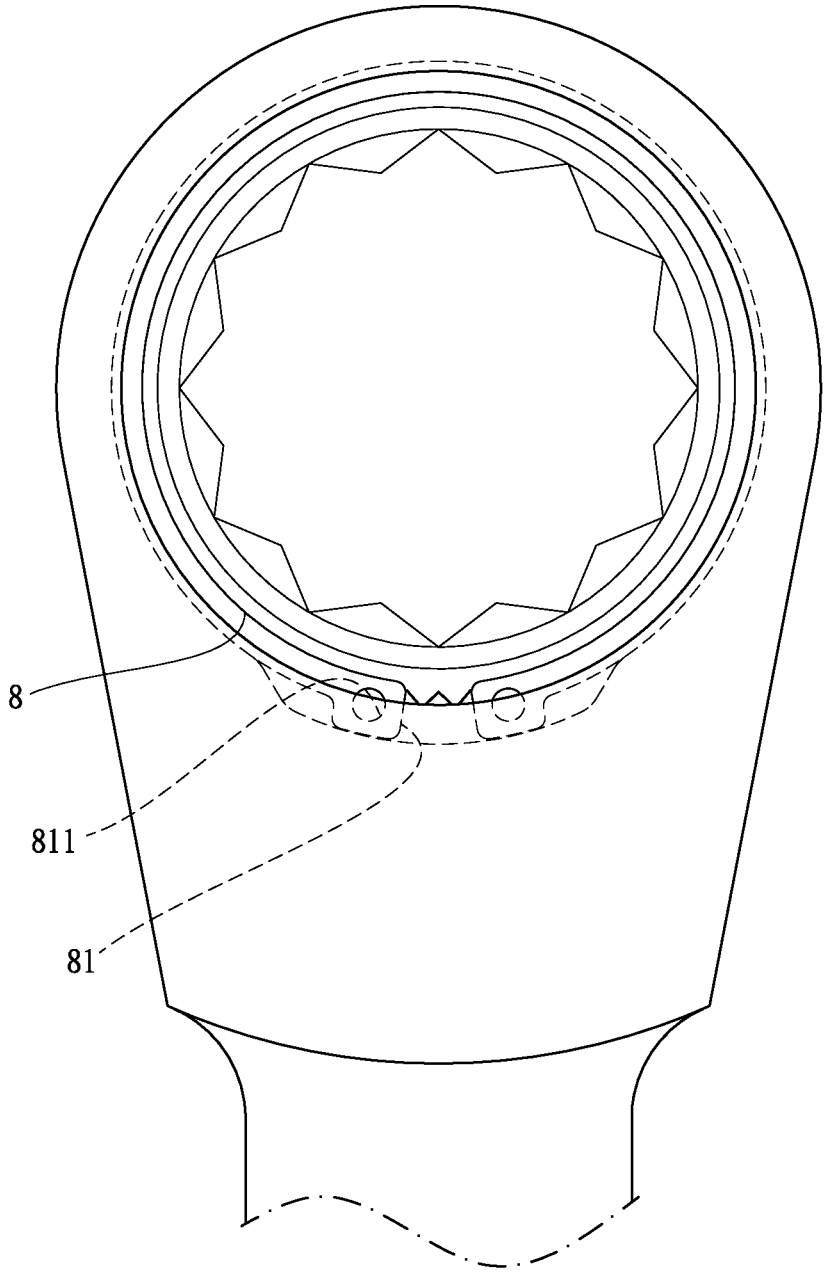
FIG.7 (Prior art)
FIG. 7 is another prior art.

In a preferred embodiment, the C-ring 3 has a gap 35 defined between the two free ends thereof so that the C-ring could be shrunk. The oblique face 33 of the C-ring 3 is inclined from the outer portion 31 to the inner portion 32 toward a central line 4 of the gap 35, as shown in FIG. 4. Therefore, the pointed edge of the C-ring 3 is defined in the inner portion 32 of the C-ring 3. In another embodiment, the oblique face 33 of the C-ring 3 is slightly concaved, as shown in FIGS. 4-5.

Referring to FIG. 1, the ratchet assembly 2 has a socket 21 mounted in the cavity 12 of the driving head 11. The socket 21 has a driving hole 211 defined therethrough and a plurality of retaining teeth 22 disposed at an inner periphery of the driving hole 211. Therefore, the socket 21 could be used to turn a fastener. Specifically, the socket 21 has a shoulder 212 at a top side, and the inner portion 32 of the C-ring 3 abuts against the shoulder 212 of the socket 21 so that the socket 21 could be retained in the cavity 12 of the driving head 11. Furthermore, a diameter of the C-ring 3 is larger than a diameter of the socket 21. Therefore, the C-ring 3 could be inserted in the retaining groove 14 and configured to retain the socket 21.

Although embodiments of this invention have been fully described with reference to the accompanying drawings, it is to be understood that various modifications can be made by those skilled in the art without departing from the scope of the invention as hereinafter claimed.

What is claimed is:

1. A ratchet wrench comprising:

a wrench body having a driving head at one end, the driving head having a cavity therein and a retaining groove defined in an inner periphery of the cavity;

a ratchet assembly mounted in the cavity of the driving head; and a C-ring defining an outer portion and an inner portion, the outer portion inserted in the retaining groove of the driving head, and the inner portion exposed to retain the ratchet assembly in place; the C-ring defining two free ends, at least one of the two free ends having an oblique face with a pointed edge towards an inside of the C-ring.

2. The ratchet wrench of claim 1, wherein the C-ring has a gap defined between the two free ends thereof; the oblique face of the C-ring is inclined from the outer portion to the inner portion.

3. The ratchet wrench of claim 2, wherein the oblique face of the C-ring is slightly concaved.

4. The ratchet wrench of claim 1, wherein the ratchet assembly has a socket mounted in the cavity of the driving head; the socket has a driving hole defined therethrough; the socket has a shoulder at a top side; and the inner portion of the C-ring abuts against the shoulder of the socket.

5. The ratchet wrench of claim 4, wherein a diameter of the C-ring is larger than a diameter of the socket.

* * * * *